United States Patent [19]

Konno

[11] Patent Number: 5,050,505

[45] Date of Patent: Sep. 24, 1991

[54] RADIO CONTROL DEVICE FOR TRACK-TRAVELLING TOY

[75] Inventor: Sunao Konno, Tokyo, Japan

[73] Assignee: Tomy Company, Ltd., Tokyo, Japan

[21] Appl. No.: 387,079

[22] Filed: Jul. 31, 1989

[30] Foreign Application Priority Data

Aug. 5, 1988 [JP] Japan ..... 63-103778

[51] Int. Cl.[5] ..... A63H 30/04

[52] U.S. Cl. ..... 104/295; 104/307; 446/456

[58] Field of Search ..... 104/304, 295, 296, 297, 104/300, 302, 307, DIG. 1; 246/3, 6 R, 6, 473; 446/454, 455, 456, 444, 445; 340/539, 825.72; 341/176; 116/252, 299, 337, 46; 455/352, 353, 66, 354, 345; 343/702

[56] References Cited

U.S. PATENT DOCUMENTS

| | | | |
|---|---|---|---|
| 3,149,607 | 9/1964 | Joseph et al. | 116/252 |
| 3,417,731 | 12/1968 | Wronke et al. | 116/252 |
| 4,854,909 | 8/1989 | Ishimoto | 446/460 |
| 4,865,575 | 9/1989 | Rosenthal | 446/219 |
| 4,878,876 | 11/1989 | Ishimoto | 446/446 |

*Primary Examiner*—Robert J. Oberleitner
*Assistant Examiner*—Mark T. Le
*Attorney, Agent, or Firm*—Staas & Halsey

[57] ABSTRACT

A radio control device for a track travelling toy includes a speed change lever which is mechanically coupled to a speed indicator so that as the selected speed changes, the speed indicator changes accordingly. The device further includes a horn activating button, and a directional control lever. The directional control lever is likewise mechanically coupled to a directional indicator.

11 Claims, 4 Drawing Sheets

RADIO CONTROL DEVICE FOR TRACK-TRAVELLING TOY

BACKGROUND OF THE INVENTION

1. Field of the Invention

The present invention relates generally to amusement devices and, more specifically, to a radio control device for controlling a drive mechanism of a travelling body on a track.

2. Description of the Related Art

Radio control devices are generally known for controlling a travelling body to stop, start and move in forward and reverse directions, and for controlling the travelling speed and operation of a direction control mechanism. Conventional radio control devices are used widely for toy automobiles, ships and airplanes, but have not been used for track-travelling toys. This is because track travelling toys are required to be provided with a direction control mechanism. Moreover, in railway toys, a train receives electric current from the rails and therefore driving of the train is controlled by other separately provided parts.

SUMMARY OF THE INVENTION

An object of the present invention is to provide a radio control device for a track-travelling toy which is capable of controlling both the movement of the toy (stop, start, forward and reverse movement) as well as a directional control mechanism which directs the movement of the toy.

Another object of the present invention is to provide a radio control device for a track-travelling toy which is relatively simple in construction and cost effective to produce.

Another object of the present invention is to provide a radio control device with a control box which imitates a driver's seat in a railway train or other track-guided toy, such that signals transmitted by a control lever simulate driving operations.

These and other objects of the invention are met by providing a radio control device for a track travelling toy having a radio receiver, device including a control box having an interior, a transmit mechanism including an antenna for transmitting control signals to the receiver, and being disposed in the interior of the control box, a speed change lever operatively coupled to the transmit mechanism for controlling a speed of the track travelling toy, indicator means for indicating the speed of the track travelling toy, and means for mechanically coupling the indicator means to the speed change lever, wherein the indicator means is driven by the speed change lever.

These objects, together with other objects and advantages which will be subsequently apparent reside in the details of construction and operation of the apparatus as more fully hereinafter described and claimed, reference being had to the accompanying drawings forming a part hereof, wherein like reference numerals refer to like parts throughout.

Figure 1:
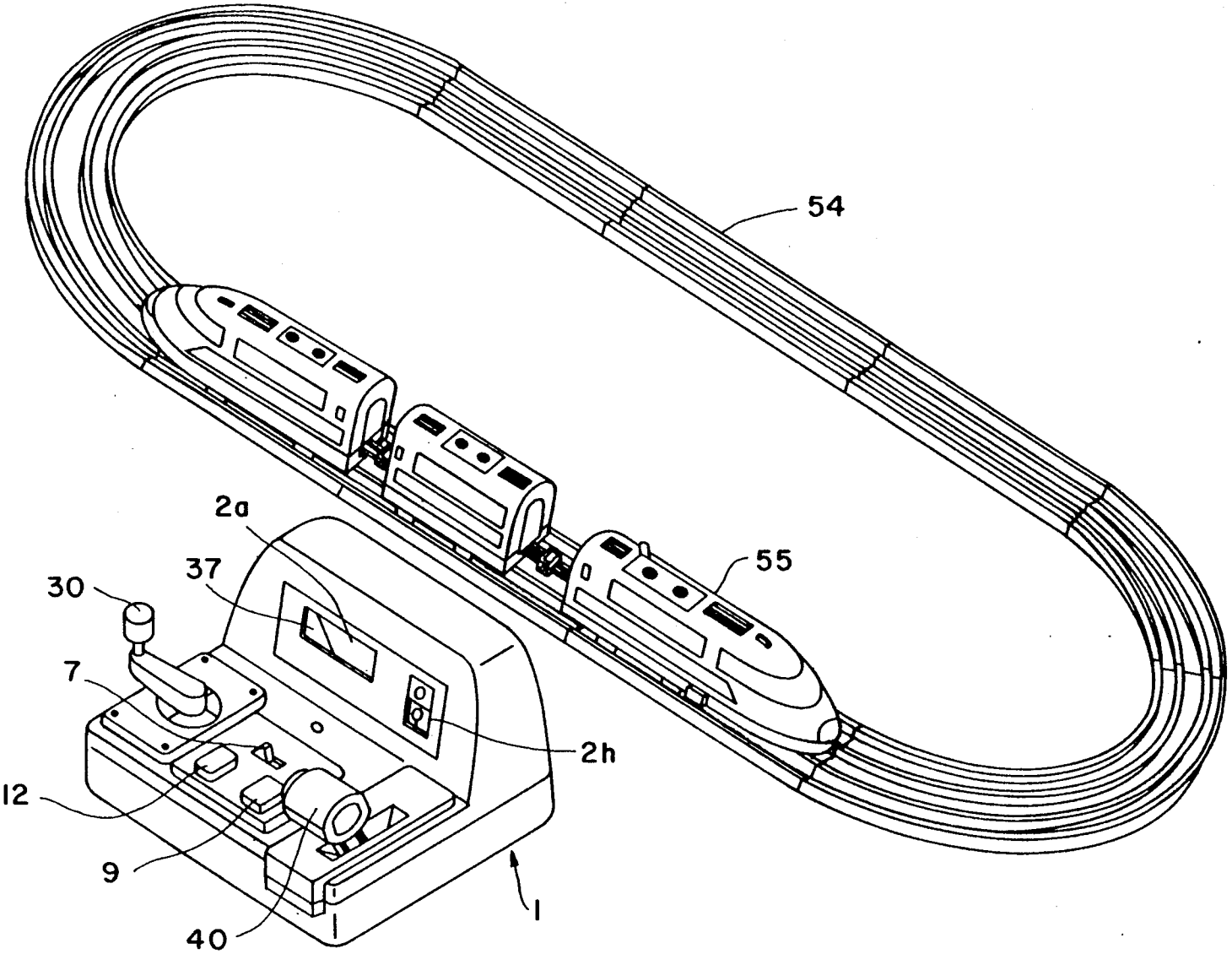
FIG. 1 is a perspective view showing a radio control device for track-travelling toy according to the present invention.
Figure 3:
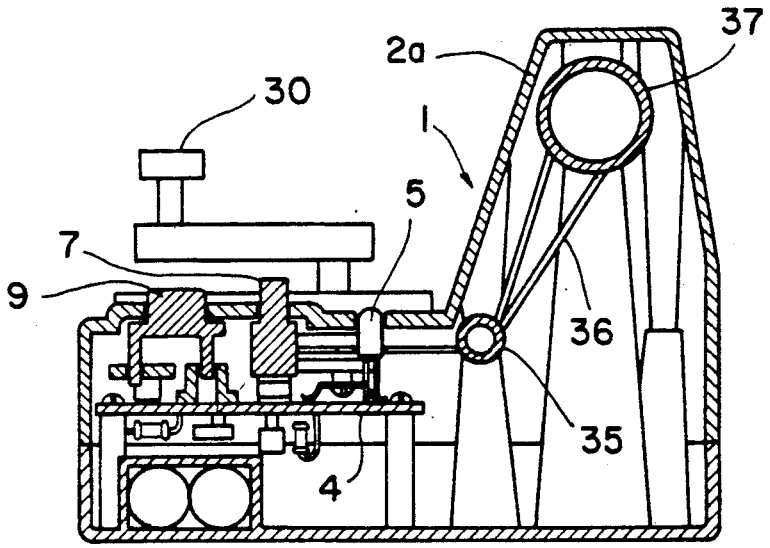
Figure 4:
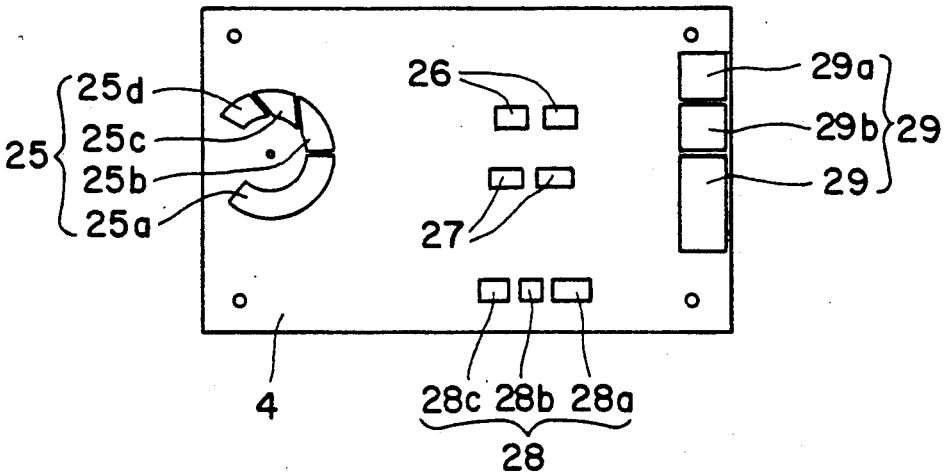
Figure 5:
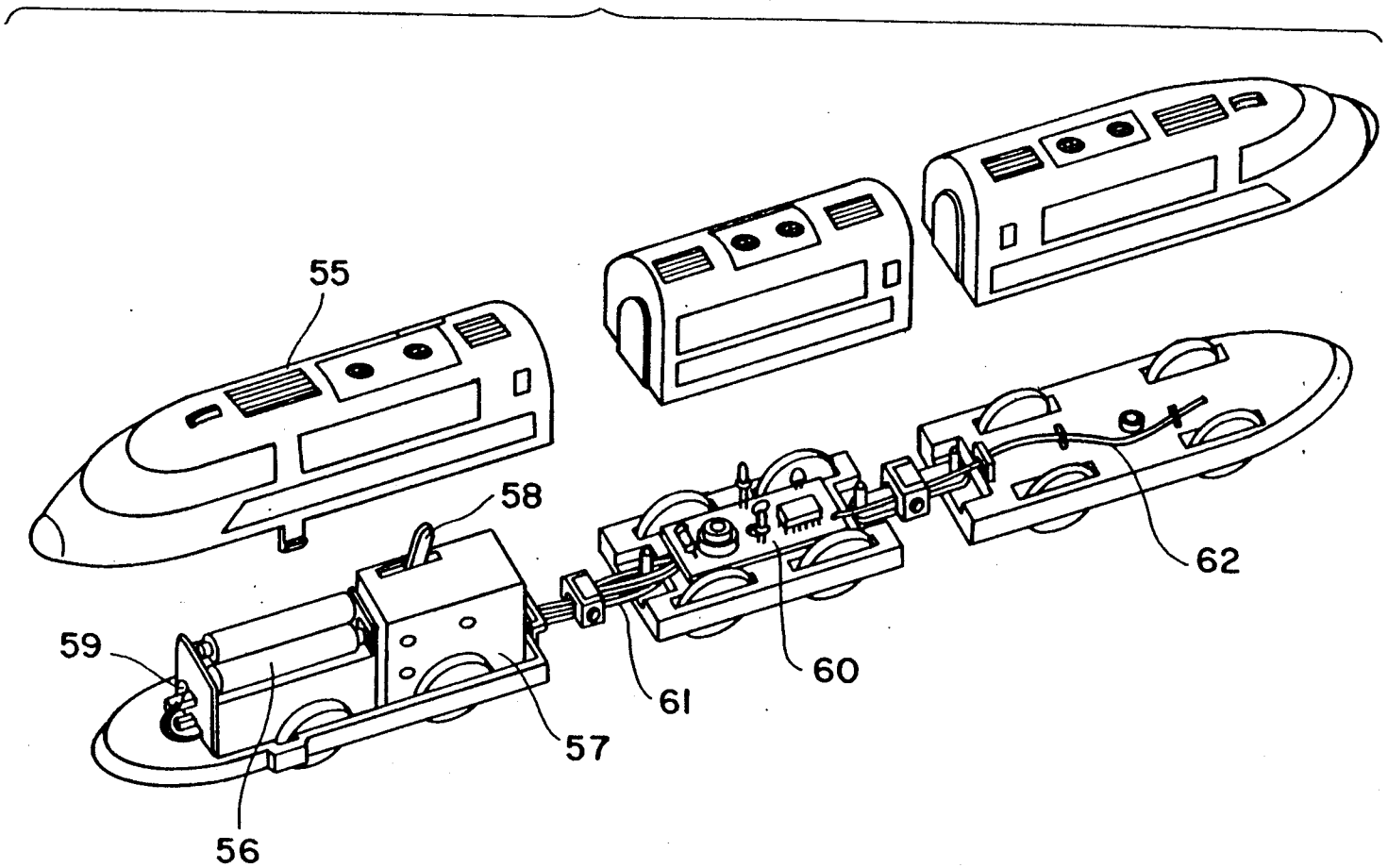

FIG. is an exploded view of the control device of FIG. 1;

FIG. 3 is a cross-sectional view of the control device of FIG. 1:

FIG. 4 is a plan view showing contacting plates provided in a printed circuit board including an emitting mechanism; and FIG. 5 is a perspective view showing the internal construction of the travelling toy.

DETAILED DESCRIPTION OF THE PREFERRED EMBODIMENTS

Referring now to FIG. 1, a control box is generally referred to by the numeral 1 and is intended to be set at a position near a track 54 on which a travelling body 55 is driven. The control box has a control panel on its upper surface. The panel includes an on-off switch 7, a button 9 activating and illuminating a light of the travelling body 55 and a button 12 for activating a horn of the travelling body. A control lever 40 is provided on the right side of the control box and extends outwardly from an upper surface thereof from a pivotal connection within the control box. A speed change lever 30 is provided on the left side of the control box 1. Control lever 40 controls the forward, reverse, stop and start actions of the travelling body 55. The lever 30 is rotatably mounted in the control box 1.

Figure 2:
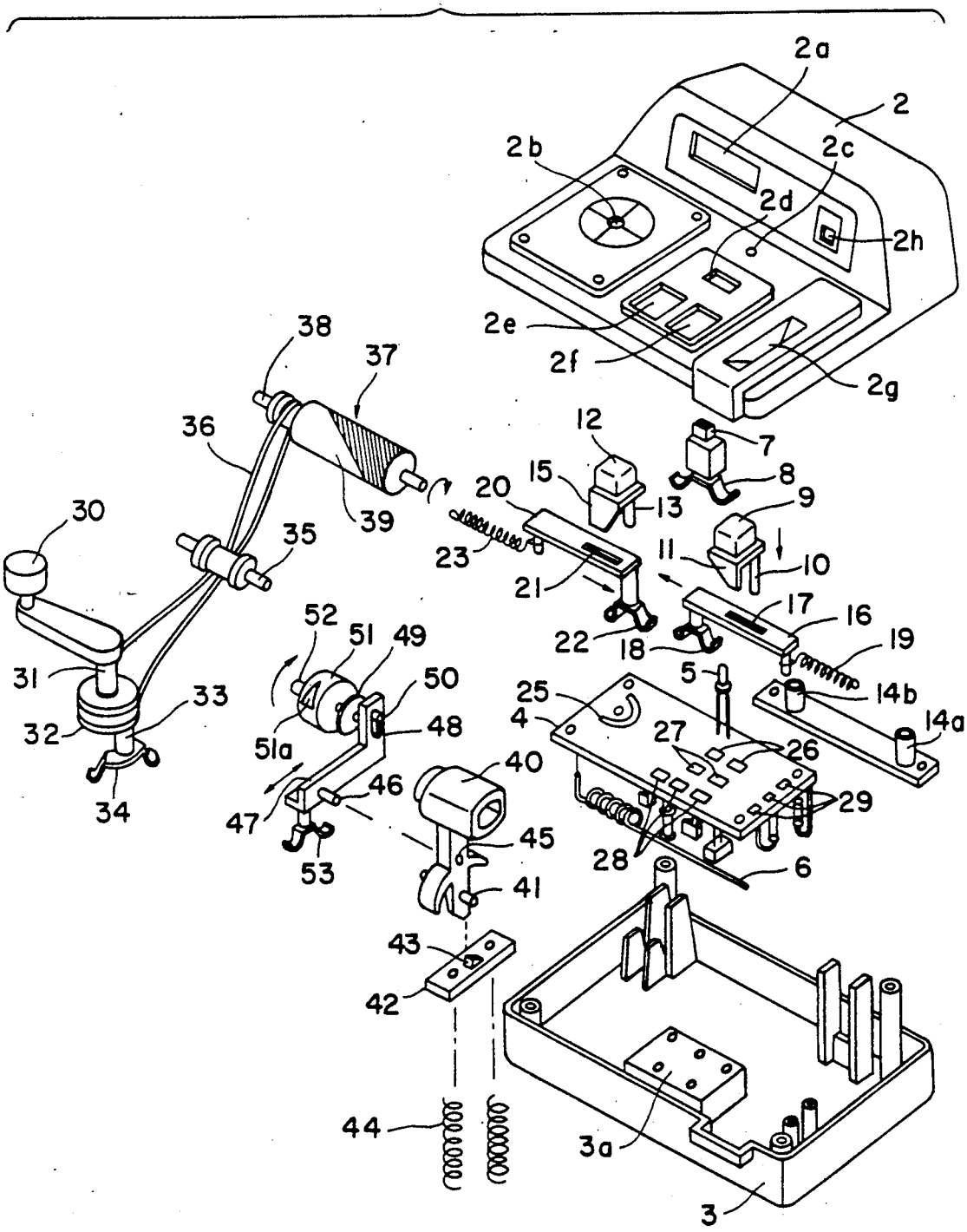

More details of the control box 1 will now be explained with reference to FIGS. 2 through 4.

The control box 1 has an upper body 2 and a lower body 3. The upper body includes a window 2*a* for indicating the travelling speed of the travelling body 55 (hereinafter referred to as "train"). Also, a window 2*h* is provided for indicating the travelling direction of the train 55. A hole, 2*c*, is formed to cooperate with an emitting element 5 which produces light for indicating when a switch is closed.

An opening 2*e* is provided for the button 12, while an opening 2*f* is provided for the button 9 to permit up and down movement of the respective buttons. A hole 2*b* is provided on the left side of the upper surface of the control panel upper body 2 to facilitate rotational mounting of the speed change lever 30, while on the right side a slot 2*g* is provided for pivotally mounting the control level 40. A battery case 3*a* is formed in the lower body 3.

A printed circuit board 4 is mounted centrally in the interior of the control box 1 and is provided with an emitting mechanism which is per se well known in the radio control device field. The proximal end of an antenna 6 is coupled to the emitting mechanism provided in the printed circuit board 4 and the distal end thereof extends in the interior of the control box 1.

The lower end of the on/off switch 7 is provided with a forked electrically conductive plate 8 for detachably connecting with a pair of contact plates 26 provided on the upper surface of the printed circuit board 4. When the forked electrically conductive plate 8 is in contact with the pair contact plates 26, the power is "ON". When one of the forked electrically plates 8 is separated from one of the contact plates 26, the power is "OFF".

A guide post 10 is formed with the button 9 and projects downwardly from a lower end thereof. The guidepost 10 is slidably fitted in a guide 14*a* mounted in the control box 1 beneath the button 9. The side of the button 9 is provided with a downwardly extending plate 11 which is fitted in a groove 17 formed in a movable plate 16. One end of the movable plate 16 has a spring 19 and the opposite end has a forked electrically conductive plate 18 which extends downwardly therefrom. The contact plate 11 has a sloped cam surface which contacts the end portion of the groove 17 such that when the button is pushed downwardly, the cam surface coacts with the groove 17 to cause the moveable plate 16 to move to the left in FIG. 2 against the spring 19. This movement of the movable plate 16 causes the forked electrically plate 18 to contact a pair of contact plates 27 provided on the printed circuit board. Once contact is made, a signal indicating a flashlight is emitted from the emitting mechanism disposed in the printed circuit board, thereby turning on the light of the train 55 which emits light 59. When the downward pressure against the button 9 is released, the movable plate is returned to its former position by the restoring force of spring 19 and the light 59 stops emitting due to the separation of the electrically conductive plate 18 from the contact plates 27.

A guide post 13 is formed on the lower side of button 12 for controlling a horn (not shown) provided in the travelling body 55. The guide post 13 is slidably received in an upwardly projecting guide 14*a*. A contact plate 15 is also formed with button 12 and has a sloped cam surface similar to the one provided on the contact plate 11. The contact plate 15 fits in a groove 21 provided in a movable plate 20 The movable plate 20 is connected to a spring 23 at one end and has a forked electrically conducting plate 22 disposed at the other end. When the button 12 is pushed downwardly, the sloped cam surface of the contact plate 15 coacts with the end portion of the groove 21 and the movable plate is moved to the right against the spring 23. The printed circuit board is provided with a connecting plate 28 which consists of three plates 28*a*, 28*b* and 28*c*. Prior to moving the movable plate to the right, the forked electrically conductive plate 22 contacts the contact plates 28*b* and 28*c* to cause an "OFF" state. When the button 12 is pushed down to move the movable plate 20 to the right as shown in FIG. 2, the conductive plate 18 contacts with the electrically conductive 28*a* and 28*b* to cause an "ON" state, whereupon the emitting mechanism provided in the printed board emits a horn signal. When the pressure against the button is released, the movable plate is returned to its original position by the restoring force of the spring 23 and the electrically connected plate 22 contacts with the contact plates 28*b* and 28*c* to cause the "OFF" state, thereby stopping the horn.

The speed change lever 30 is used for controlling a drive and speed of the train 55. A rotational shaft 31 projects downwardly from the bottom end of the speed change lever 30 and passes through the hole 2*b* provided in the control box 1. A pulley 32 is fixedly connected on a lower portion of the rotational shaft 31, and an eccentric shaft 33 projects downwardly from a lower surface of the pulley 32. A forked electrically conductive plate 34 is joined to a lower end of the eccentric shaft 33.

An elongated drum 3 is rotatably mounted for rotation about a substantially horizontal axis behind the window 2*a* of the control box 1. An indicator 39 indicates the travelling speed of the train 55 by showing indications provided on the outer surface of the drum 37 through the window 2*a*. For example, the drum 37 is colored with yellow or red lines on its periphery to form the indications 39 thereby correlating speed with the length of the indications visible in the window 2*a*.

A belt 36 is provided between the pulley 32 of the speed change lever 30 and the shaft 38 which rotatably mounts the drum 37. A guide bar 35 is provided between the drum 37 and the pulley 32 to guide the belt 36 which extends between the pulley 32 and the drum 37. Thus, the drum is caused to rotate by the belt 36 when the speed change lever 30 is actuated.

The indications appear in the window 2*a* to indicate the speed of the travelling body. A contact plate 25, consisting of four contacting plates 25*a*, 25*b*, 25*c* and 25*d* is formed beneath the forked electrically conducting plate 34 on the upper side of the printed circuit board 4. When the rotation of the speed change lever 30 is limited in the counterclockwise direction as shown in FIG. 2, both ends of the electrically conducting plate 34 contact with the contact plate 25*a* and 25*d*, thereby causing the emitting mechanism to emit a "STOP" signal. In this position, the indications 39 of the drum 37 are not visible in the window 2*a*. When the speed change lever 30 is rotated in a clockwise direction through a predetermined angle, the electrically conductive plate 34 contacts with the contact plates 25*a* and 25*c*, thereby causing the emitting mechanism to emit a "low speed travelling" signal. Then, the drum 37 rotates in a clockwise direction as shown in FIG. 2 in order to cause the indications 39 in a corresponding amount to appear in the window 2*a*. When the speed change lever 30 is rotated in a clockwise direction as shown in FIG. 2, the electrically conductive plate 34 contacts with the contact plates 25*a* and 25*c*, thereby causing the emitting mechanism to emit a "high speed travelling" signal. In this case, the drum 37 rotates in a clockwise direction as shown in FIG. 2 to move the indications from left to right to indicate that the train 55 is moving at a high speed.

The control lever 40 is used for controlling the forward and reverse directions of movement for the train 55. A shaft 41 is provided at the lower end of the control lever 40 for pivotally mounting the lever 40 in the lower body 3 of the control box 1. The upper end thereof moves through the slot 2*g*. The lower end of the control lever 40 is movable into contact with an upper portion of a push plate 42 which is biased upwardly by spring 44 from the lower side. The push plate has a projection 43 formed medially on an upper surface thereof. The projection 43 is used for positioning the control lever 40.

A hole 45 is provided in a medial portion of control lever 40 for receiving a pin 46 which projects radially outwardly from a link 47. One end of the link 47 is provided with a forked electrically conductive plate 53 which extends downwardly therefrom and the other end is L-shaped with an elongated hole formed in the vertical, short portion of the L. The hole 48 receives an eccentric pin 50 provided on a rotation plate 49 which is rotatably mounted on a shaft 52. A drum 51 is also mounted on the shaft 52 and has an outer periphery which is provided with an indication portion 51*a* for indicating the travelling direction of the train 55. The indication portion 51*a* is visible through the window 2*h*. When the control lever 40 is pushed ahead, the lower end of the control lever 40 moves over the projection 43 so that the link 47 moves to the right as shown in FIG. 2. The drum 51 is then rotated by the cooperative movement of the eccentric pin 50 and the elongated hole 48, whereupon a triangular-shaped indicating portion 51*a* provided on the outer periphery of the drum 51 indicates the forward direction of the train 55 by showing its top end in the upper portion of the window *2h*.

The forked electrically conductive plate 53 provided on the link 47 then contacts with the contact plates 29*a* and 29*c*, so that the emitting mechanism emits a "forward" or "ahead" signal. When the control lever 40 is pulled rearwardly (away from the window *2h*), the link 47 moves to the left as shown in FIG. 2. Then, the top end of the triangular-shaped indicating portion 51 appears by showing its top at the bottom side of the window *2a*. The forked electrically conductive plate 53 contacts the electrically conductive plates 29*b* and 29*c*, thereby causing the emitting mechanism to emit a "reverse" signal.

The travelling body may be in the shape of an electrical railcar or train and has a driving mechanism in the leading car. A light 59 is also arranged at the front of the leading car and has batteries 56 stored therein. A frame 57 includes a motor and drive gears (not shown), and a switch lever 58 is arranged to project upwardly therefrom. The leading car is connected with the second car by means of a coupling, and the second car is provided with a well known printed board including a receiving mechanism and a horn mechanism. The third Car is coupled to the second car and carries the receiving antenna 62 which is connected to the receiving mechanism.

The train 55 receives the signal submitted from the control box 1 which is determined by the control lever, and the train can be caused to flash light, sound a horn, proceed in forward and reverse directions, and change speed or stop. Moreover, the relative speed of the train can be determined by the indicator which constitutes a rotating drum which is provided with a scale, graduated markings, or other indications which indicate relative speed. Because of the combination of the various controls and functions of the train, the radio control device effectively simulates the feel of controlling a real train.

The many features and advantages of the present invention are apparent from the detailed specification, and thus, it is intended by the appended claims to cover all such features and advantages of the radio control device which fall within the true spirit and scope of the invention. Further, since numerous modifications and changes will readily occur to those skilled in the art based upon the disclosure herein, it is not desired to limit the invention to the exact construction and operation illustrated and described. Accordingly, all suitable modifications and equivalents may be resorted to, falling within the scope and the spirit of the invention.

What is claimed is:

1. A radio control device for a track travelling toy having a radio receiver, comprising:

a control box having an interior;

a transmit mechanism including an antenna for transmitting control signals to the receiver, and being disposed in the interior of the control box;

a speed change lever operatively coupled to the transmit mechanism for controlling a speed of the track travelling toy;

indicator means for indicating the speed of the track travelling toy;

means for mechanically coupling the indicator means to the speed change lever, wherein the indicator means is driven by the speed change lever;

a directional control lever pivotally mounted in the control box and being operatively coupled to the transmit mechanism for selecting a direction of movement of the track travelling toy; and second indicator means for indicating the selected direction of movement of the travelling toy, and second means for mechanically coupling the second indicator means to the directional control lever, wherein the second indicator means comprises a drum rotatably mounted in the control box and visible through a window provided in the control box, and the second mechanical coupling means comprises a link pivotally connected to the directional control lever and having an electrical contact at one end which moves in response to movement of the directional control lever and an elongated slot provided at the opposite end for receiving an eccentric shaft of the drum so that the drum rotates in response to the sliding movement of the link.

2. A radio control device according to claim 1, wherein the speed change lever is rotatably mounted on the control box and includes a moving electrical contact which selectively contacts an electrical contact of the transmit mechanism for controlling a speed signal emitted by the transmit mechanism.

3. A radio control device according to claim 2, wherein the indicator means comprises a cylindrical indicator rotatably mounted in the control box and visible through a window provided in the control box.

4. A radio control device according to claim 3, wherein the means for mechanically coupling the speed change lever to the indicator means includes a first pulley rotatable with the speed change lever and a second pulley rotatable with the cylindrical indicator, and an endless belt carried by the first and second pulleys.

5. A radio control device according to claim 1, wherein the transmit mechanism transmits one of a plurality of signals corresponding to a low speed signal, a high speed signal, and a stopping signal, and the speed change lever includes a moving electrical contact which moves with rotation of the speed change lever, the transmit mechanism including a corresponding electrical contact, the relative positioning of which relative to the moving contact of the speed change lever determining the signal to be transmitted by the transmit mechanism.

6. A radio control device according to claim 1, further comprising a horn activating button extending outwardly from the control box and being operatively coupled to the transmit mechanism for selectively issuing a horn activation signal from the transmit mechanism.

7. A radio control device according to claim 6, further comprising a first sliding plate having a slot formed therein, a contact plate and guide post formed integrally with the horn activating button, the contact plate having a sloped cam surface and being movable through the slot of the first sliding plate, a spring connected to one end of the sliding plate, and an electrical contact provided at the other end of the sliding plate, the sliding plate being movable against the spring in response to downward movement of the horn activating button to move the electrical contact into and out of electrical contact with the transmit mechanism.

8. A radio control device according to claim 1 further comprising a light activating button mounted on the control box, and being operatively coupled to the transmit mechanism for selectively transmitting a light activating signal which activates a light provided on the travelling toy.

9. A radio device according to claim 8 further comprising a second sliding plate having a slot formed therein, a contact plate and guide posts integrally formed with the light activating button, the contact plate having a sloped cam surface and being movable through the slot of the second sliding plate, a second spring connected to one end of the second sliding plate and a second electrical contact provided on the opposite end of the sliding plate so that downward movement of the light activating button imparts sliding movement in the second sliding plate to thereby move the second electrical contact.

10. A radio control device for a track travelling toy having a radio receiver, comprising:

a control box having an interior;

a transmit mechanism including an antenna for transmitting control signals to the receiver, and being disposed in the interior of the control box;

a speed change lever operatively coupled to the transmit mechanism for controlling a speed of the track travelling toy;

indicator means for indicating the speed of the track travelling toy;

means for mechanically coupling the indicator means to the speed change lever, wherein the indicator means is driven by the speed change lever;

a horn activating button extending outwardly from the control box and being operatively coupled to the transmit mechanism for selectively issuing a horn activation signal from the transmit mechanism; and a first sliding plate having a slot formed therein, a contact plate and guide post formed integrally with the horn activating button, the contact plate having a sloped cam surface and being movable through the slot of the first sliding plate, and an electrical contact provided at the other end of the sliding plate, the sliding plate being movable against the spring in response to downward movement of the horn activating button to move the electrical contact into and out of electrical contact with the transmit mechanism.

11. A radio control device for a track travelling toy having a radio receiver, comprising:

a control box having an interior;

a transmit mechanism including an antenna for transmitting control signals to the receiver, and being disposed in the interior of the control box;

a speed change lever operatively coupled to the transmit mechanism for controlling a speed of the track travelling toy;

indicator means for indicating the speed of the track travelling toy;

means for mechanically coupling the indicator means to the speed change lever, wherein the indicator means is driven by the speed change lever;

a light activating button mounted on the control box, and being operatively coupled to the transmit mechanism for selectively transmitting a light activating signal which activates a light provided on the travelling toy; and a second sliding plate having a slot formed therein, a contact plate and guide posts integrally formed with the light activating button, the contact plate having a sloped cam surface and being movable through the slot of the second sliding plate, a second spring connected to one end of the second sliding plate and a second electrical contact provided on the opposite end of the sliding plate so that downward movement of the light activating button imparts sliding movement in the second sliding plate to thereby move the second electrical contact.

* * * * *